US006497008B1

(12) United States Patent
Schlepfer et al.

(10) Patent No.: US 6,497,008 B1
(45) Date of Patent: Dec. 24, 2002

(54) PROCESS FOR REMOVING FIBER FLOCKS FROM BALES WITH A BALE OPENING DEVICE

(75) Inventors: Walter Schlepfer, Winterthur (CH); Nikolaus Lagler, Winterthur (CH); Reto Kummli, Pfäffikon (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/787,213

(22) PCT Filed: Sep. 17, 1999

(86) PCT No.: PCT/IB98/01638

§ 371 (c)(1),
(2), (4) Date: Sep. 21, 2001

(87) PCT Pub. No.: WO00/17427

PCT Pub. Date: Mar. 30, 2000

(30) Foreign Application Priority Data

Sep. 18, 1998 (CH) ..... 1913/98

(51) Int. Cl.[7] ..... D01B 1/00
(52) U.S. Cl. ..... 19/80 R; 19/145.5
(58) Field of Search ..... 19/80 R, 81, 145.5, 19/300; 241/30, 33, 101.742; 318/482; 414/273

(56) References Cited

U.S. PATENT DOCUMENTS 4,363,585 A * 12/1982 Keller et al. ..... 19/145.5
4,493,131 A * 1/1985 Dragagna et al. ..... 19/145.5
4,660,257 A * 4/1987 Binder et al. ..... 19/300
4,813,615 A * 3/1989 Hosel et al. ..... 241/101.742
4,951,358 A * 8/1990 Binder et al. ..... 19/80 R
5,105,507 A * 4/1992 Staheli et al. ..... 19/80 R
5,495,642 A * 3/1996 Trutzschler ..... 19/80 R
5,564,165 A * 10/1996 Zander ..... 19/80 R

* cited by examiner

*Primary Examiner*—Danny Worrell
*Assistant Examiner*—Gary L. Welch
(74) *Attorney, Agent, or Firm*—Dority & Manning

(57) ABSTRACT

A method for operating a bale opening machine (1) includes the step of defining a desired normal or operational take-off depth for the take-off device or extraction member (6) to be applied to all of the bales (7) of the bale lie. An actual take-off depth is computed for predetermined positions along the bale line as a function of the normal take-off depth and factors computed for the respective positions to take into account bale height differences and density differences between the bales. With respect to the bale height differences (4MAX–aMIN), the take-off factors have a proportional value based on a bale height at the respective positions compared to a total bale height difference between the highest and lowest bales. A total bale height is recomputed prior to each pass of the take-off device and the actual take-off depth factors are set to a value of 1 if the computed total bale height difference is reduced to at least the magnitude of the normal take-off depth. The bale density factors are applied simultaneously with the height take-off factors and are computed based on a percentage of bale height and a perceived density characteristic of each bale.

27 Claims, 7 Drawing Sheets

Fig. 5
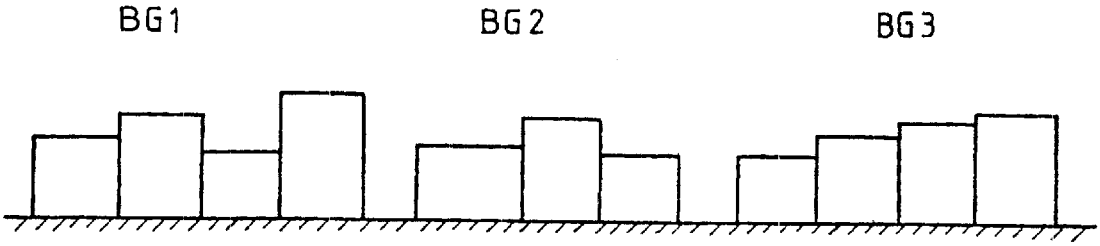
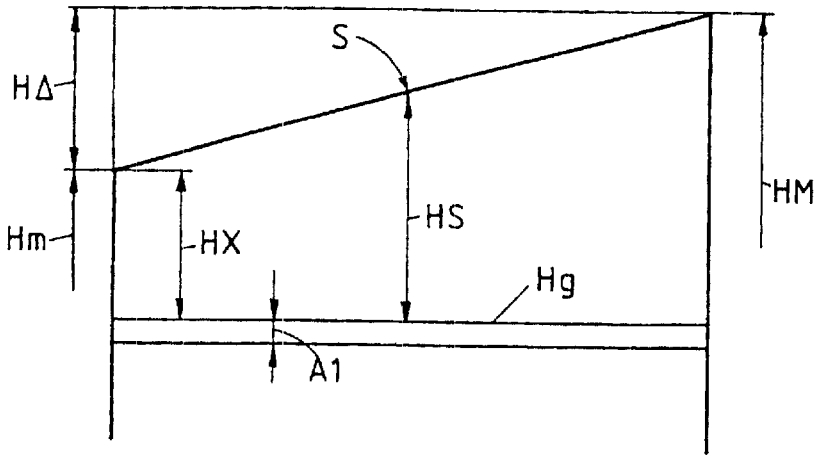
Fig. 6
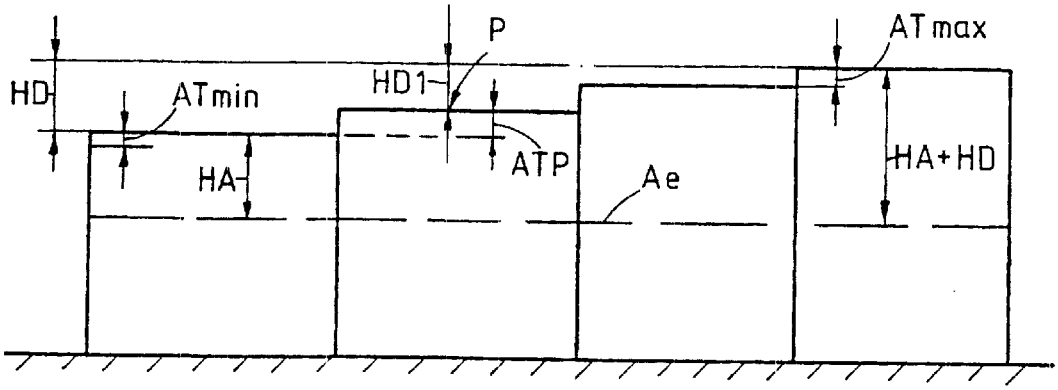
Fig. 9

PROCESS FOR REMOVING FIBER FLOCKS FROM BALES WITH A BALE OPENING DEVICE

BACKGROUND OF THE INVENTION

The present invention relates generally to bale opening devices, and more particularly to a method for controlling a bale opening device in order to extract or remove fiber flocks from a line or row of bales.

Bales of fiber material are normally laid down in rows on the spinning mill floor to form a "bale laydown." The bale laydown may include a different number of bale groups. The height profile or surface contour of the bale laydown depends on a number of factors. For example, compression of the fiber material in the bales before the bale ties are opened, the relative humidity of the various bales, and the selection process applied by the mill operators for selecting and arranging the bales to be laid down in a given bale group are all factors affecting the profile or contour of the bale line.

Once the bales are arranged in the bale laydown, flocks are extracted by a computer controlled take-off element which covers generally the width of the bales in the bale line and which can be moved longitudinally along the upper surface of the bales. For this purpose, the contour or profile of the bales is usually scanned by corresponding sensors and the profile entered into a computer. Furthermore, based on a predetermined bale extraction program, a certain number of passes and the take-off depth per passage of the take-off element can be preset for a fiber layer height and the flocks can be extracted accordingly by the take-off element.

It is known in the art to control the take-off element program according to a number of factors. For example, it is known to use suitable height level sensors to scan the height profile of the bale line with the results being entered into a control device for controlling the take-off element as a function of density or hardness within the bale. U.S. Pat. No. 4,660,257 describes such a device wherein the extracting member or take-off element extracts fiber flocks from the upper bale surfaces with a penetration depth into the bales that is variably dependent on the bale height. The penetration depth of the extraction member is gradually reduced in an upper bale region doing a predetermined number of passes from a maximum value to a lesser penetration depth that has been determined for a middle bale region. The bales are subdivided into a plurality of height zones that exhibit different densities of fiber material. The penetration depth of the take-off element in a middle zone is maintained until reaching a lowermost zone in which the penetration depth is again gradually increased. The control system includes a microprocessor which stores inputted desired number of passes and penetration depths for the different height zones and controls the take-off element accordingly. This type of program control based upon a height density profile also has application in the present invention and will be described in greater detail herein.

U.S. Pat. No. 5,564,165 deals with a method of controlling the take-off element in order to reach an equalization of the different fiber bale heights so that the take-off element extracts the same depth of fiber material consistently along the bale line. According to the control method of the '165 patent, the bale height of all the bales in the bale line is determined by sensors carried on the bale opener and input into a computer. The operator inputs into the computer a vertical feed or penetration depth of the detaching device for the bales in the bale line that have a minimum bale height.

The operator also inputs a common bale height for all of the bales wherein no change in the penetration depth is required. It is at this height that equalization of the bales will have taken place. The computer then determines a proportionately higher feed for the bales other than those having the minimum bale height so that equalization is achieved at the common bale height. Thus, according to this control system, the spinning mill operator determines at which height equalizing of the bales heights is to be completed and the take-off depth for the lowest bale. The computer then calculates the take-off requirements needed for the higher bales to achieve equalization at the desired common height.

U.S. Pat. No. 5,105,507 describes another method for controlling a take-off element in a fiber extraction device wherein the height profile of the row of bales is determined by at least one sensor that is directed towards the upper bale surface. This sensor is preferably an optical or acoustical sensor and the received signal from the sensor is processed to obtain a signal corresponding to the hardness of the bales. The penetration depth of the take-off element is controlled or regulated in accordance with the hardness signal.

The present invention relates to a control method for a fiber extraction device that reliably and accurately accounts for bale height differences and density characteristics of the bale line.

OBJECTS AND SUMMARY OF THE INVENTION

It is thus a principal object of the present invention to provide an improved control method of operating a bale opening machine having a fiber extraction or take-off element for removing desired layers of fiber material from a row of bales.

Additional objects and advantages of the invention will be set forth in part in the following description, or may be obvious from the description, or may be learned through practice of the invention.

In accordance with the invention, a control method is provided for operating any manner of bale opening machine having a fiber extraction or take-off element controlled by a computer control system. It should be appreciated that the present control method is not limited to any particular configuration of bale opening machine, and has application wherever it is desired to control the penetration depth of the fiber extraction member or take-off element. The only requirement is that the bale opening machine have appropriate sensors for determining the bale heights or bale profile as described herein, as well as a control system for operating the take element. Although not essential to the invention, the bale opener is preferably provided with sensors enabling it to derive the necessary information. For example, bales may be laid down on opposite sides of a track along which the bale opener moves and the bale opener can process bales on one side of the track while a movable sensor, e.g. on a separate carriage, detects the heights or the profile of bales on the other side of the track.

In this regard, a method according to the invention is provided for operating a bale opening machine having a take-off device for removing a desired depth of material in a take-off layer from a top surface of a line of bales as the take-off device passes over the bale line. The method includes the step of determining a total height difference between a low point and a high point along the bale line. The high point may correspond to the highest or tallest of the bales and the low point may correspond to the lowest or shortest of the bales. This step of determining the total height difference may be carried out in any manner. For example, the height of the bales may be measured and the height difference calculated from the measured heights. In another embodiment, the total height difference may be determined based solely on a height differential of the bale profile. In other words, it is not critical that the actual heights of the bales relative to the mill floor be determined for this purpose. The concern is not the actual bale heights, but the difference in bale height between the highest and lowest points.

The method includes the step of defining a desired normal or operational take-off depth for the take-off device as a function of the necessary through put production of the bale opening machine. The through put production is related to a number of factors, including the downstream requirements in the fiber processing line.

Actual take-off depths for the take-off device are computed by the control system for predetermined control positions along the bales to be processed. The control positions may have a predetermined spacing and the control system configured so that the locations of the control positions are stored for use in each pass of the take-off element. The control positions may correspond to the individual positions at which the bale opener samples the bale line in an initial pass of the take-off element. The actual take-off depths are a function of the normal take-off depth and relative bale height at the respective positions along the bale line with respect to the total height difference. The take-off device is then controlled according to the actual take-off depths at the predetermined positions for each pass of the take-off device along the bale line.

Prior to each pass of the take-off device, a new total height difference is calculated or determined between the low and high points of the bale line. If the new total height difference is less than or equal to the magnitude of the normal take-off depth, then the control system sets the actual take-off depths for all points along the bale line to eliminate the effect of bale height equalizing factors applied to the value of the normal take-off depth.

The step of computing the actual take-off depths preferably comprises the step of assigning a minimum and maximum take-off factor for the low and high points of the bale line. Each such factor may be selected from a predetermined range stored in the control system. In a basic embodiment, this program range may not be variable. The factors may be selected independently from the program ranges. For example, respective ranges may be stored for the minimum take-off factor and the maximum take-off factor and a selection may be required from each range to compute take-off depths. Alternatively, the factors may be effectively "paired" so that a selection of one of the two factors determines the other. The selection may be made in terms of a percentage of the available range. The factors may be preprogrammed in the system and "retrieved" based upon a measured or inputted bale height difference. For example, the operator may input an initial bale height difference and, based on this difference, the system will automatically select the appropriate range of the factors (provided variable ranges are programmed). Corresponding take-off factors for the control points along the bale line are then computed by the system as a proportional function of the ratio of the bale height difference at the respective positions to the total bale height difference. The computed take-off factors are then applied to the normal take-off depth to calculate the actual take-off depth at the respective control positions along the bale line. In other words, a maximum take-off factor is assigned to the highest bale height position and a minimum take-off factor is assigned to the lowest bale height position. Proportional take-off factors are computed for the other positions along the bale line based on the ratio of the height difference at the respective positions compared to the total height difference between the minimum and maximum bale heights.

In a preferred embodiment of the present control method, the initial set of take-off factors is applied for each subsequent pass of the take-off device until the total height difference between the high and low bale heights is reduced to at least the magnitude of the normal take-off depth. In this regard, the total height difference between the low and high points of the bale line is measured or computed prior to each pass of the take-off element. However, the take-off factors are not necessarily recomputed and the initial set of take-off factors may be used for each pass of the take-off element. The new total height difference may be computed prior to each pass based on the previous total height difference and the take-off depths at the high and low bale heights utilized in the previous pass of the take-off device. Thus, it should be understood that the new calculations may be carried out by the control system without relying on actual sensor inputs or signals relating to the bale heights.

The present method also preferably comprises steps for controlling the take-off depth at the positions along the bale line as a function of bale density by applying a bale density factor in the computation process for the actual take-off depths at the respective control positions along the bale line. The bale density factors may be based upon a predetermined or perceived bale density characteristic of the bales. The bale density factors may also be applied at discrete height portions of the bales. These discrete height portions may be defined as a percentage of initial bale height. For example, an operator may enter the perceived bale density characteristic into the control system of the bale opening device. The control system may have density factors stored therein corresponding to different bale density characteristics. The control system will apply the appropriate density factors to portions of the bales that are determined as a function of bale height. It may be preferred to apply the density factors to only a top and bottom portion of the bales. A middle height portion of the bales need not be corrected for density. The percentages that define the top and bottom portions may also be a factor of perceived bale density and also stored in the control system such that the operator need only to input the density characteristic of the bale. The control system will then apply the appropriate density factor and compute the appropriate height portions in which to apply the density factors.

The height take-off factors and density factors are then applied to the normal take-off depth to define the actual take-off depth at the control positions along the bale line. The take-off element is controlled as a function of the height take-off factors and density take-off factors for each pass of the take-off device.

BRIEF DESCRIPTION OF THE DRAWINGS

FIG. 3*b* is a diagram of a height profile for the bale laydown of FIG. 3*a.

DETAILED DESCRIPTION

Figure 1:
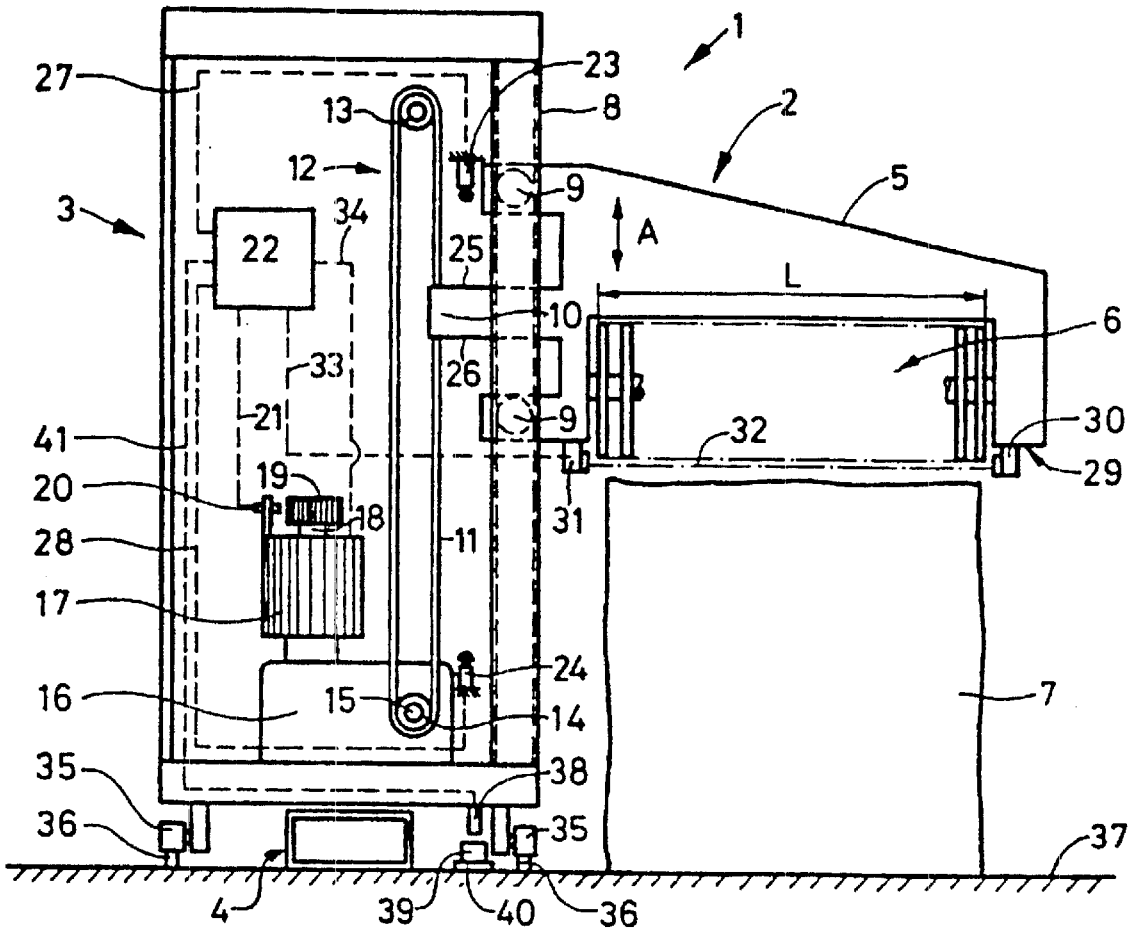
FIG. 1 is a diagrammatic side elevational view of a conventional bale opening machine equipped with a type of control system which may be used to practice the present method.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

The present control method for operating a bale opening machine is applicable to any manner of bale opening machine wherein the penetration depth of the take-off element is controlled by a control system. In this regard, it should be appreciated that the present inventive method is not limited to any particular configuration of bale opening machine. Computer controlled bale opening machines are well known by those skilled in the art and a detailed explanation thereof is not necessary for purposes of the present description. For example, the present inventive method may be utilized with the bale opening machines described in U.S. Pat. Nos. 5,105,507; 5,564,165; and 4,660,257. The entire descriptions of the cited U.S. patents are incorporated herein by reference in their entirety for all purposes.

FIG. 1 is similar to the sole figure of U.S. Pat. No. 4,660,257 and is provided for a brief explanation of a conventional bale opening machine. Referring to FIG. 1, reference numeral 1 identifies a bale opening machine for extracting textile fiber flocks. The machine 1 comprises an extraction member or take-off element 2, a machine frame 3 and flock transport system 4. The take-off element 2 comprises a housing structure 5 in which a driven extraction roller 6 is supported for rotation. Flocks are extracted from bales 7 by the roller 6 and are taken up by housing 5 and transported in a non-illustrated manner into the flock transport system 4.

Housing 5 is movable up and down in the direction of arrow A and a pair of rollers 9 are rotatably mounted on housing 5 and guided in guide rails 8 of machine frame 3. Only one of the roller pairs 9 and rails 8 is shown in the figure.

Housing 5 further includes an engaging member 10 which is fixedly secured to a chain 11 of a chain drive 12. Chain drive 12 includes a rotatably supported upper sprocket 13 for reversal in direction of movement of chain 11, and a lower sprocket 14 to drive chain 11. Lower sprocket 14 is secured to a drive shaft 15 of a transmission 16. An electric motor 17 is connected to transmission 16 and may comprise, for example, a step motor. Chain drive 12, gear transmission 16, and motor 17 are collectively referred to as a reciprocating drive mechanism.

A gear wheel 19 is secured to an upper end 18 of the shaft of motor 17. Gear wheel 19 operates, together with a sensor 20, as a type of pulse generator. The output of this device is fed via a lead line 21 to a microprocessor 22 of the control system. Sensor 20 may be of any commercially available type and produces a pulse each time it is passed by a tooth of the gear wheel 19.

An upper end switch 23 and a lower end switch 24 are provided for sensing the upper and lower end positions of the extraction member 2 on the machine frame 3. Upper end switch 23 is operated by an upper surface 25 of engaging member 10, and lower end switch 24 is operated by a lower surface 26 on engaging member 10. The upper end switch 23 supplies its output signal to microprocessor 22 via lead 27.

An optical device comprising an emitter 30 and a receiver 31 may be provided on a lower side 29 of housing 5 facing bale 7. The optical device 30 and 31 are so arranged that the emitter 30 generates a light beam 32 passing over the entire width L of extraction roller 6. Light beam 32 is converted in the receiver 31 into a signal supplied via lead 33 to the microprocessor 22. A further lead 34 connects motor 17 with microprocessor 22.

Machine frame 3 is arranged to travel along bales 7 and above the flock transport system 4. This movement is enabled by wheels 35 drivably secured to frame 3 and resting on rails 36 which are typically secured to a floor 37 of the spinning mill.

In operation, bales 7 are typically arranged in a line or bale laydown that may be further divided into bale groups. The individual bales within a bale group are preferably arranged by the mill operator such that the bales 7 of a similar height and/or fiber origin or "sort" are arranged together. The bale opener can treat one fiber sort (bale group) differently from the next and may include a set of program routines for opening the different bale groups to achieve a desired flock combination, as explained in U.S. Pat. No. 4,951,358 (incorporated herein in its entirety for all purposes). A bale laydown having three bale groups is shown in FIG. 5. Preferably, a locating means or system is provided for locating the machine frame at the end positions of the bale groups. The locating means may comprise, for example, a sensor 38 on the underside of machine frame 3 and positioning elements 39 disposed along the length of the bale laydown to differentiate the different bale groups. Positioning elements 39 are adjustably positioned on a rail 40. The presence of the positioning elements 39 is detected by sensor 38 and indicated to the microprocessor 22 via lead line 41. Thus, the start position and end position for machine 1 in its direction of travel for the respective bale groups is defined by positioning elements 39. It is also known in the art to distinguish between bale groups based on detecting a gap between the bale groups. This system is applicable to the present invention as well.

The sensing system illustrated in FIG. 1 and described herein, and particularly described in U.S. Pat. No. 4,660,257, is particularly suited for determining bale heights of the individual bales in the bale group. Accordingly, this system is particularly applicable with regards to the density compensation aspect of the present inventive method, as is described in detail in U.S. Pat. No. 4,660,257.

In an initialization step, extraction member or take-off element 2 moves through the distance from upper end switch 23 to lower end switch 24. In the course of this movement, microprocessor 22 counts the pulses emitted by sensor 20 in response to gear wheel 19 and, thus, the spacing or height between the end positions is determined.

In an initial operation step, take-off element 2 is in the upper position and machine 1 travels along bale 7 until the take-off element 2 is located above the bale group as determined by sensor 38 and positioning element 39. Take-off element 2 is then lowered in response to a control signal from microprocessor 22 until light beam 32 is interrupted by the bale group. During this lowering, the pulses caused by gear wheel 19 are subtracted in the microprocessor from the pulse total so that when take-off element 2 stops as a result of interruption of light beam 32, the height of this particular bale is established. This process may be repeated for individual bales within the group or at predetermined positions along the bale group. The process may also be repeated if additional bale groups are provided in the bale laydown.

Thus, with the particular type of sensing system described above, an accurate actual height of the bales can be determined. These heights may be used in establishing the density take-off factors to be applied in the calculation of the actual take-off depth of the take-off element 2, and also to determine the height portions or zones in which the density take-off factors are applied. The measured heights may also be used in calculating the height differences applicable to the bale height take-off factor calculations.

Figure 2A:
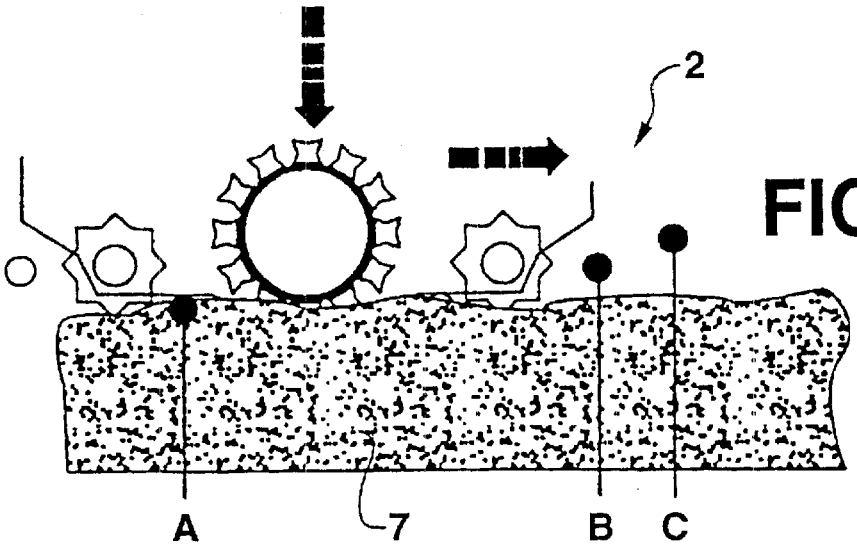
FIGS. 2*a*–2*c* are operational diagrammatic views of the take-off element and sensor arrangement of a bale opening machine that may be used to practice the present method.
Figure 2B:
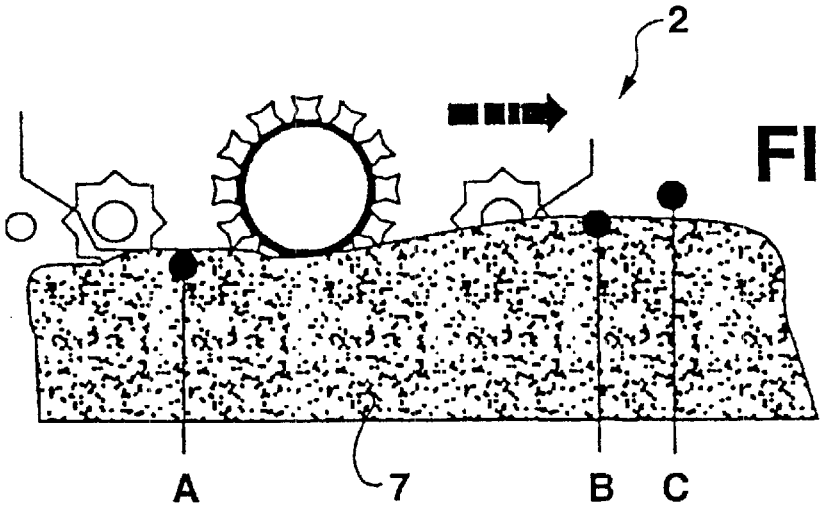
Figure 2C:
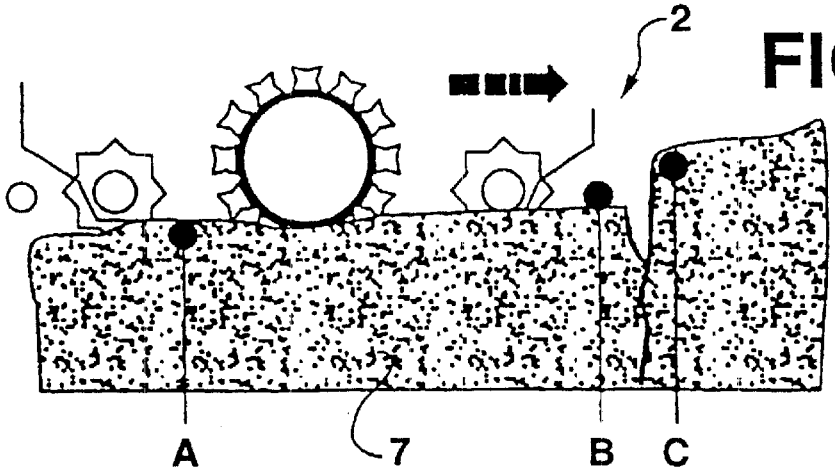

FIGS. 2*a* through 2*c* diagrammatically illustrate an optical sensor arrangement that also may be used in practice of the present invention. This type of sensor arrangement may be used to determine a contour or height profile of the bales and is similar to the optical sensor arrangement described in U.S. Pat. No. 5,564,165. This sensor arrangement is also used for controlling the height position of the take-off element as it moves over the bales. In this arrangement, take-off element 2 includes three optical sensors A, B, C which define three barrier lines. Two of the optical sensors B, C, are disposed at a leading edge of take-off element 2 and are offset longitudinally and height wise. The third optical sensor A is disposed on the opposite side of roll 6. With this type of system, in an initialization pass of take-off element 2 over bales 7, take-off element 2 is lowered until roll 6 penetrates into bales 7 and the barrier defined by sensor A is interrupted by the upper surface of the bales. Machine 1 is then moved along the bale line in the direction indicated by the arrow in the figures. Detector C is positioned to detect relatively great changes in bale height. Detector B is positioned to detect smaller changes in bale height.

Referring to FIG. 2*a,* take-off element 2 will continue to the right at a constant penetration depth of roller 6 until either of the optical barriers defined by sensors B and C are interrupted by a change in bale height. Referring to FIG. 2*b,* it can be seen that a slight increase in bale height has interrupted the barrier of sensor B. Sensor B will send an appropriate signal to the microprocessor control system which will then cause take-off element 2 to raise as it continues to travel along the bale line until the optical barrier established by sensor B is again uninterrupted. FIG. 2*c* illustrates sensor C being interrupted by an abrupt change in bale height. A signal from sensor C will cause take-off element 2 to be raised at a greater rate (slope) and at an earlier time or position relative to the horizontal position along the bale laydown. The rearward sensor A detects when the bales decrease in height. For example, if the bales decrease in height and the optical barrier established by sensor A becomes uninterrupted, take-off element 2 will be driven lower until sensor A again indicates that roller 6 is correctly disposed above an upper surface of a bale.

Figure 3A:
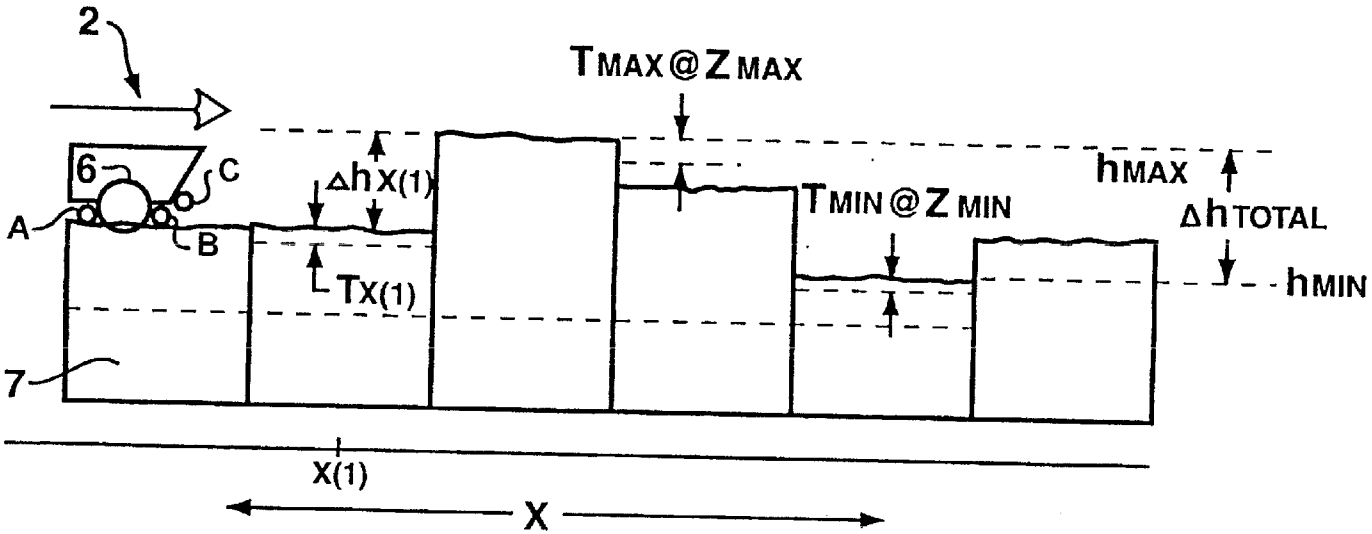
FIG. 3*a* is a diagrammatic view of a bale laydown illustrating certain principles of the present invention.
Figure 3B:
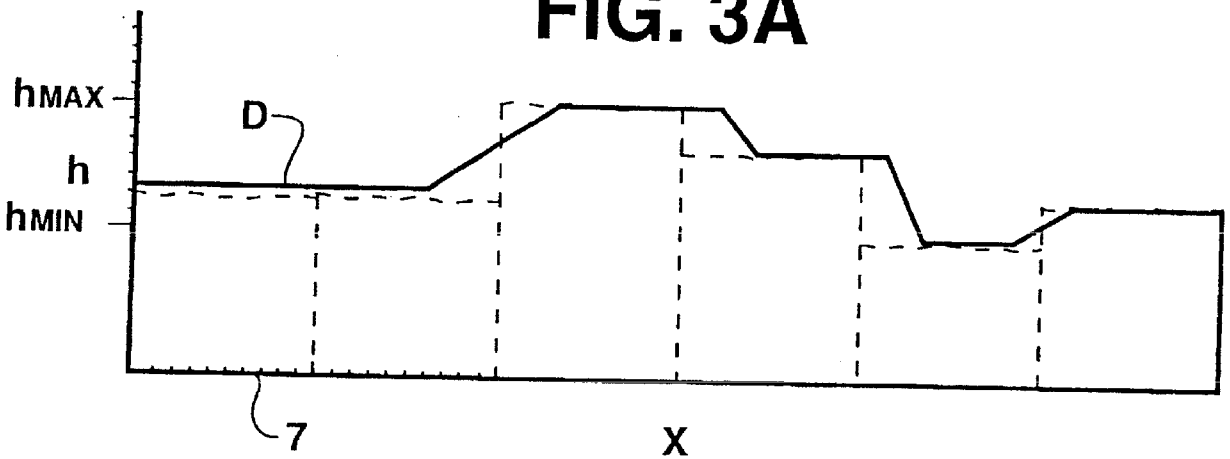

FIGS. 3*a* and 3*b* diagrammatically illustrate operation of the type of sensor system illustrated in FIGS. 2*a* through 2*c*. For example, referring to FIG. 3*a,* it can be seen that bales 7 of varying height are disposed along the bale laydown. Take-off element 2 is located above the left hand bale 7. FIG. 3*b* illustrates a height profile D generated by the system for the bale laydown illustrated in FIG. 3*a*. As take-off element 2 moves along the first two bales, it can be seen that sensors B and C are uninterrupted. Thus, a constant height signal is generated. The third bale has a significant height increase and sensor C is interrupted before sensor B. This will cause the control system to move take-off element 2 upwards at a relatively great rate or slope as the element continues to move to the right until the system again indicates that the bales are at a relatively constant height. As the take-off element 2 moves over the third bale, it will continue to move at relatively constant height until rear sensor A determines that the bales have decreased in height. At this point, take-off element 2 will be lowered, as illustrated in FIG. 3*b*. This process will continue along the upper contour of the bales. A relatively small height increase exists between the fifth and sixth bale. In this instance, take-off element 2 will continue along the upper surface of the fifth bale until sensor B is interrupted by the sixth bale. This will cause take-off element 2 to be raised, but at a lower rate (slope) and at a later point in time than if sensor C were interrupted.

It can be seen from FIG. 3*b* that height profile D does not exactly correspond to the actual height profile of the bale laydown. This is due to the fact that the take-off element 2 continues to move along the bale line as it is raised or lowered according to changes in bale height. It can also be seen from FIG. 3*b* that at certain positions along the bale laydown, roller 6 is not penetrating any portion of a bale. This is a desirable feature in that eventually the system is driven so that the height profile D is "smoothed" out with each pass of the take-off element 2 so that an equalizing of the bales by height is established.

With the system of FIGS. 2 and 3 described above, it should be appreciated that a height profile for the entire bale laydown can be established. The data or control points along the horizontal or X axis of the bale laydown will depend on the sampling frequency or distance established by the operating system.

It should be further appreciated that the optical sensing system of FIGS. 2 and 3 may be utilized in combination with the height sensing system of FIG. 1. For example, the optical sensing system of FIGS. 2 and 3 may be configured with a pulse counting system to generate an actual height for the bale groups. Since the optical sensing system accurately determines the height differential between bales in the bale group, actual height of any individual bale is easily determined by the system so long as the actual height of any bale within the group is known. This may be determined in an initial pass or initialization procedure of the take-off element 2. It is well within the level of skill of those in the art to utilize any combination of height or profile type sensors in a control system in order to practice the method of the present invention.

A control method of this invention will be described in greater detail with reference to FIGS. 3*a* and 3*b*. The bale height compensation aspect of the present control method will be described first.

Referring to FIG. 3*a,* it can be seen that bales 7 in the bale laydown comprise varying bale heights. A minimum bale height $h_{MIN}$ is the bale height at the lowest surface point of the bale laydown. A maximum bale height $h_{MAX}$ is the bale height at the highest surface point. $h_{MIN}$ and $h_{MAX}$ may be determined in an initialization pass of take-off element 2 above the surface of bales 7. The control system calculates a total height difference $\Delta h_{TOTAL}$ between $h_{MIN}$ and $h_{MAX}$ as follows:

$$\Delta h_{TOTAL}=h_{MAX}-h_{MIN}$$

Roll 6 of take-off element 2 penetrates into the upper surface of the bales a desired penetration depth referred to herein as a "take-off depth." A "normal" or operational take-off depth $T_{NORM}$ is determined as a function of the through-put requirements of the bale opening machine.

$T_{NORM}$ is the theoretical take-off depth that is required to fulfill production requirements and is the take-off depth that theoretically should be applied uniformly across all of the bales. $T_{NORM}$ is a value input by the machine operator into the control system.

In order to compensate for height differences between the bales, a bale height factor Z is applied to the normal take-off depth $T_{NORM}$. The bale height factor Z determines the ratio between the maximum take-off depth for use on taller bales and the minimum take-off depth for use on shorter bales and enables determination of an appropriate factor for any bale height in between the maximum and minimum bale heights in the bales to be processed. In a preferred arrangement, the bale height factor Z is composed from two height factors $Z_{MIN}$ and $Z_{MAX}$ associated respectively with the shorter and taller bales. Each of the two factors may be selected from a respective range of possible values, the limits of each range being predetermined in the control program. The two ranges preferably diverge in different directions from a common value of unity. For example, the operator may enter a $Z_{MIN}$ value of 0.8 and a $Z_{MAX}$ value of 2.0. It has been found that values for $Z_{MIN}$ between 0.5 and 1.0 and values for $Z_{MAX}$ between 1.0 and 3.0 are appropriate. $Z_{MIN}$ is the height take-off factor that is applied to $T_{NORM}$ to give the actual take-off depth at the minimum bale height ($T_{MIN}$) as follows:

$$T_{MIN}=T_{NORM}\times Z_{MIN}$$

Likewise, $Z_{MAX}$ is the take-off factor applied to the normal take-off depth $T_{NORM}$ for the highest bale height to compute actual take-off depth at the highest bale height ($T_{MAX}$) as follows:

$$T_{MAX}=T_{NORM}\times Z_{MAX}$$

A Z factor is computed for each data point along the horizontal line or axis of the bale laydown (e.g. at X(1)) as a proportional function of the height difference at the respective point X compared to the total height difference $\Delta h_{TOTAL}$. This proportional ratio may be determined in any number of ways including the following:

$$Zx = Z_{\mathrm{MAX}} \times \left(1 - \frac{\Delta hx}{\Delta h_{TOTAL}}\right)$$

Accordingly, Zx is the height take-off factor at a given location X along the bale line that is applied to normal take-off depth $T_{NORM}$ to give the actual take-off depth at the respective position X as follows:

$$Tx=(Zx)(T_{NORM})$$

$$\text{Where } Zx \text{ is a function of } \left(1 - \frac{\Delta hx}{\Delta h_{TOTAL}}\right).$$

For each pass (n) of the take-off element, Zx is applied at the respective X position without recalculating Zx even though $\Delta h_{TOTAL}$ and $\Delta hx$ have changed due to the previous pass of the take-off element. In an alternative embodiment, the control system may recalculate Zx for each subsequent pass.

For each subsequent pass (n+1) a new $\Delta h_{TOTAL}$ is computed to account for the layer of material removed in the previous pass of the take-off element. The new $\Delta h_{TOTAL}$ can be computed mathematically as follows:

$$\Delta h_{TOTAL}(n+1)=(h_{MAX}(n)-(T_{MAX}(n))-h_{MIN}(n)-T_{MIN}(x))$$

Thus, $\Delta h_{TOTAL}$ is recomputed to account for the layer of material removed at the highest and lowest points by the take-off element in the previous pass. These values were previously computed by the system and actual height determinations need not be made.

Even though a new $\Delta h_{TOTAL}$ is recomputed for each pass (n+1) of the take-off element, it is not necessary to recompute the factors Zx with the new $\Delta h_{TOTAL}$ value. The new $\Delta h_{TOTAL}$ value is a limiting control valve for the control system. Prior to each pass, the new $\Delta h_{TOTAL}$ is computed and compared to the value or magnitude of $T_{NORM}$ that was initially entered by the operator. If the new $\Delta h_{TOTAL}$ for the pass (n+1) is greater than $T_{NORM}$, then another pass of the take-off element is conducted using the same height take-off factors Zx as before. If the computed new $\Delta h_{TOTAL}$ for pass (n+1) is less than or equal to the value of $T_{NORM}$, then the control system sets the height take-off factors Zx to 1 at all positions along the bale line. Thus, $Tx=1\times T_{NORM}=T_{NORM}$ for all control points along the bale line. At this point, the take-off element will take off a constant depth of material along the entire bale laydown.

Referring to FIG. 3*b*, it should be appreciated that the height profile curve D will be "smoothed out" or evened for each additional pass of the take-off element wherein the height factors Zx are applied until eventually the height factors Zx are set to 1 and a constant take-off depth $T_{NORM}$ is established. It should, however, also be appreciated that the condition wherein $T_{NORM}$ is established may not occur depending on the value of $h_{TOTAL}$ and the Z factors input into the system by the operator. If the total height difference $h_{TOTAL}$ is great in relation to the permitted ranges of the Z factors, then the control system may never realize complete equalization wherein $T_{NORM}$ is established across the bale laydown. The range of the Z factors is obviously a physical limitation of the bale opening device and must be established in this regard. In other words, regardless of the value of $Z_{MAX}$, take-off element 2 is limited in its penetration depth. The value of $T_{NORM}$ for a currently conventional bale opener lies in the range of 2 to 6 mm. A height factor Z therefore represents an increase to between 6 and 18 mm, which latter is close to the limit of the physical processing capacity of the machine. For this reason, it is advantageous to define the ratio of maximum to minimum take-off depth in terms of two factors diverging in different directions from "1" to obtain the desired ratio both by increasing the maximum take-off depth relative to normal and by reducing the minimum take-off depth relative to the same starting value. This is especially advantageous when allowance also has to be made for other factors affecting take-off depth, as will be explained further on with reference to FIG. 4.

It is not essential that each factor shall be chosen independently. The factors may be linked by a predetermined relationship; for example, a given shift of the $Z_{MAX}$ factor away from "1" may be associated with a corresponding (predetermined) shift of the $Z_{MIN}$ factor away from "1." For the operator, this can conveniently be represented in terms of a "1% change" of normal take-off. If, for example, the operator decides that $T_{NORM}$ should be increased by 20% to give $T_{MAX}$ in order to deal with the height difference in the bales, this instruction may be processed by the computer to give a corresponding $Z_{MAX}$ and the control system may also automatically select a factor $Z_{MIN}$ giving a reduction of, for example, 10% in $T_{NORM}$ to derive $T_{MIN}$. The operator is thus relieved of the necessity to input two factors.

In fact, it is not essential that the operator shall input any selection at all. In a preferred embodiment, the Z-factors are predefined as a function of the detected height difference. Accordingly, the bale opener is in a position to derive the required factors for itself as soon as it is provided with the bale profile information. For example, preprogrammed factors may be stored in the system that correlate to detected or inputted height differences between the bales. Once the system is provided with the height difference (for example by direct measurement or input by the operator), the appropriate Z-factor range will be established based on the magnitude of the height difference and the system will automatically assign the proportional Z-factors within the selected range to the control points. Nonetheless, it will usually be desirable to provide for an override function that enables the operator to select the factors if desired.

If the computer is programmed to select the factors for itself, then it may be enabled to select those factors in dependence upon predetermined additional criteria, for example, to achieve equalization after a given number of passes or at a predetermined height. The preferred height for achieving equalization is close to but above ground level, as proposed in U.S. Pat. No. 5,105,507. The bale opener may be programmed to operate on each bale group individually. However, if the control system is programmed to select the Z-factors itself, then it can be programmed to achieve a common take-off plane for each of a number of adjacent bale groups, thus enabling the bale groups to be "completed" simultaneously.

It is not essential that the control system be programmed to recalculate the operation at the start of each pass. The control system can compute a "picture" of the complete operation on a given set of bales and can thus determine, for example, the number of the pass on which equalization will be achieved. The control system can also include a pass counter and the effect of the equalization program can then be canceled when the predetermined pass has been counted. Alternatively, the profile sensor on the bale opener could be kept in operation and could provide a signal indicating achievement of equalization, which can be used by the control system to cancel the effect of the equalization program.

The present control method also preferably accounts for bale density by defining a bale density factor that is also applied to $T_{NORM}$ in computing the actual take-off depth Tx at the respective positions X along the bale laydown. However, it should be appreciated, that the bale height compensation system as described above may be utilized independent of the bale density compensation control features. Likewise, the bale density compensation feature may be utilized independent of the height differential program.

Figure 4:
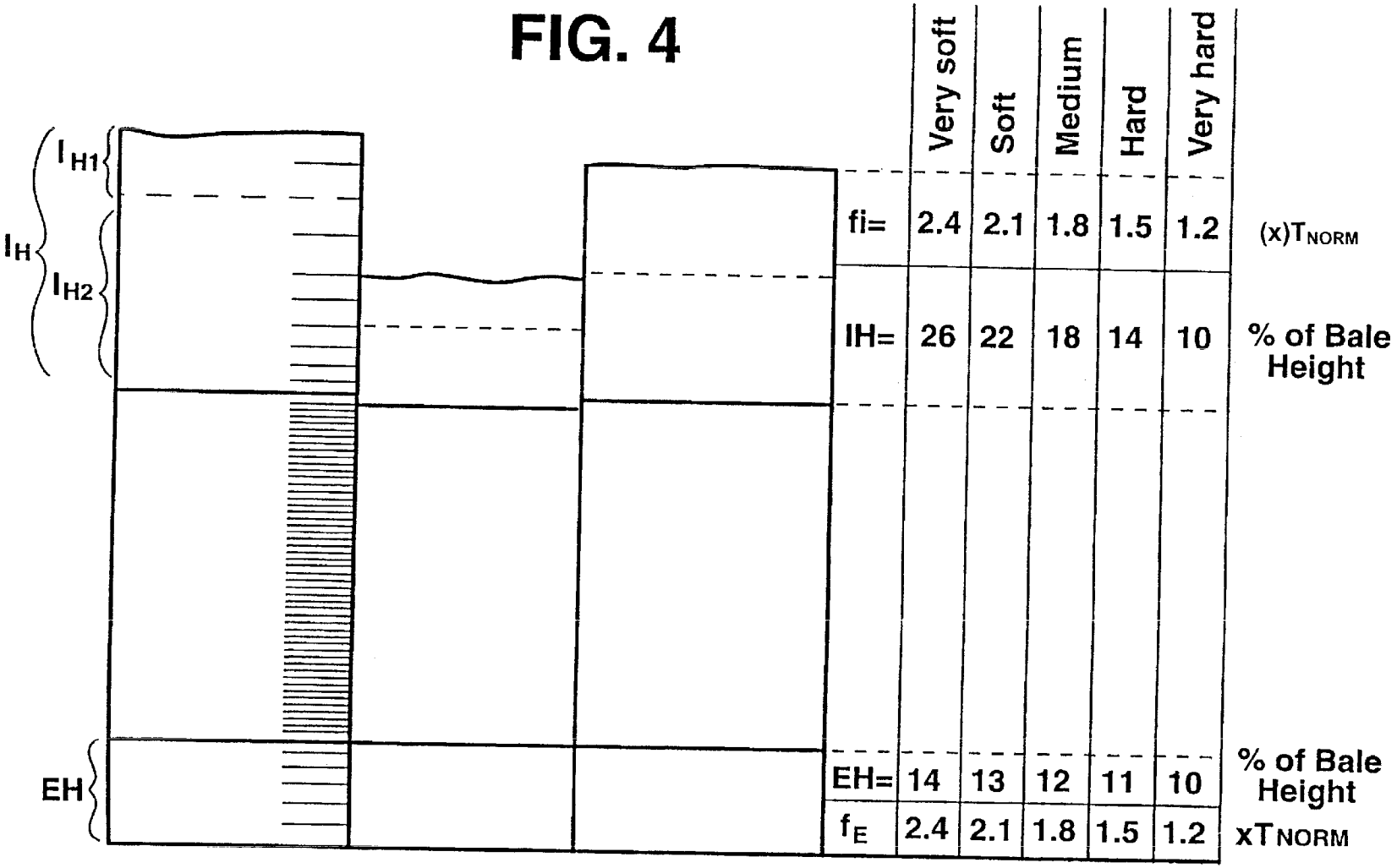
* and FIG. 4 is a density compensation diagram illustrating certain principles of the present invention.

FIG. 4 diagrammatically illustrates the bale density compensation program. This system is similar to the control system described in U.S. Pat. No. 4,660,257, the entire disclosure of which is incorporated herein in its entirety for all purposes. Referring to FIG. 4, an initial bale height is determined for each of the bales in the bale group. This bale height may be established in an initial pass of the take-off element and may be computed or measured with any combination of sensors or control elements. Once the bale height has been determined, the system empirically divides the bales into discrete height portions. An in-feed height IH at which a bale density factor $f_i$ is applied to $T_{NORM}$ is established in an upper height zone of the bale. Likewise, an end-feed height section EH is established at a lower portion of the bales wherein a bale density factor fe is applied to $T_{NORM}$. The height portion between sections IH and EH are not considered to be materially affected by compression of the bale material and density factors are not applied to the bales within this middle portion.

Referring again to FIG. 4, the in-feed IH and end-feed EH sections are determined as a percentage of bale height based on a perceived density of the bale. For example, the operator may input any perceived bale density from very hard through very soft, as indicated in FIG. 4. Depending on the categories inputted by the operator, the in-feed and end-feed sections are established as a percentage of height. For example, if the bale density characteristic is inputted as "medium", then the in-feed section is established as 18 percent of the bale height and the end-feed section is established as 12 percent of the bale height. FIG. 4 gives various percentages found suitable in this regard for the various density characteristics.

Referring to FIG. 4, it can be seen that the end-feed heights are generally uniform for all of the bales. The end-feed is determined based on the appropriate percentage applied to the tallest of the bales. For example, for a "medium" density characteristic of the tallest bale, the end-feed height is established as 12 percent of the bale height. This bale height is then established across all of the bales regardless of the other bale heights.

Referring again to FIG. 4, each density profile or characteristic is also assigned a density factor fi for the in-feed section and a density factor $f_E$ for the end feed section. Again, referring to the "medium" density characteristic, the density factor $f_E$ to be applied in the in-feed section IH is 1.8. The same factor is applied in the end-feed section. However, it is not a necessity that the factors be the same for both the in-feed and end-feed sections. The factors are determined empirically and are entered and stored in the control system. The factors may be changed or varied as the operator sees fit or as conditions dictate.

As can be seen in FIG. 4, the in-feed section IH may be further subdivided into two subsections IH1 and IH2. In the uppermost section IH1, the density factor $f_1$ is applied directly to the normal take-off depth $T_{NORM}$ for all passes of the take-off element to yield the take-off depth $T_{IH1}$ in section IH1. IH1 may be set as a percentage of height or as a certain number of passes of the take-off element. In section IH2, the take-off depth is progressively reduced to the value of $T_{NORM}$ (without consideration to the height factors) according to the following process:

a. The number of passes of the take-off element ($n_2$) through the section IH2 is computed as follows:

$$\frac{T_{NORM} + T_{IH1}}{2} = T_{AVG}$$

$$\frac{IH2}{T_{AVG}} = n_2$$

b. The take-off depth for each pass is then computed as follows:

$$\frac{T_{IH1} - T_{NORM}}{n_2} = \Delta T$$

For each pass n, the take-off depth for that pass is $T_{IH2}(n)+T_{IH1}-(n)(\Delta T)$ In this manner, the take-off depth for each subsequent pass through section IH2 is gradually reduced so that $T_{NORM}$ is established in the middle portion of the bales (again, without consideration to the height compensation factors).

Once the bales have been reduced in height to the end-feed portion EH, the density factors are again applied to the value of $T_{NORM}$.

Thus, it should be appreciated that the control system may simultaneously compensate for height differences between the bales as well as density considerations. The height differences are compensated for by the general relationship: $Tx=Zx\times T_{NORM}$. The density compensation is reflected by the general principal: $Tx=T_{NORM}\times(f_1 \text{or } f_E)$. The combined relationship is given by the general equation: $Tx=T_{NORM}\times(Zx)\times(f_1 \text{ or } f_E)$. Thus, for every data point X along the bale laydown, an actual take-off depth Tx is computed with consideration given to bale height differences and density differences.

The computation of the new $\Delta h_{TOTAL}$ with regards to the bale height compensation program as discussed above, takes into account application of the various density factors so that the new $\Delta h_{TOTAL}$ accurately reflects the additional penetration depth in the in-feed section IH or end-feed section EH as a result of the density compensation program.

ADDITIONAL DETAILED DESCRIPTION

Figure 7:
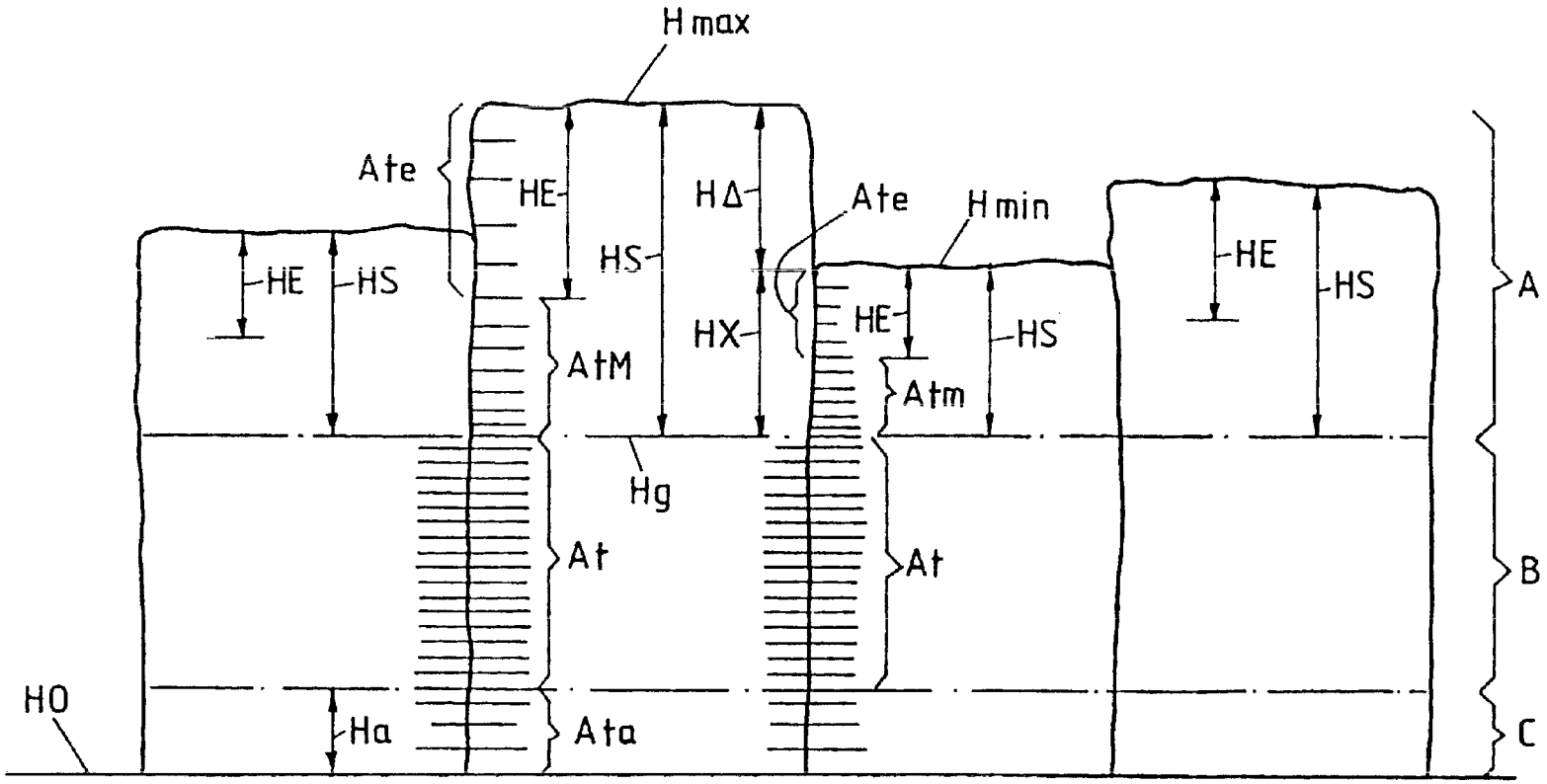
Figure 8:
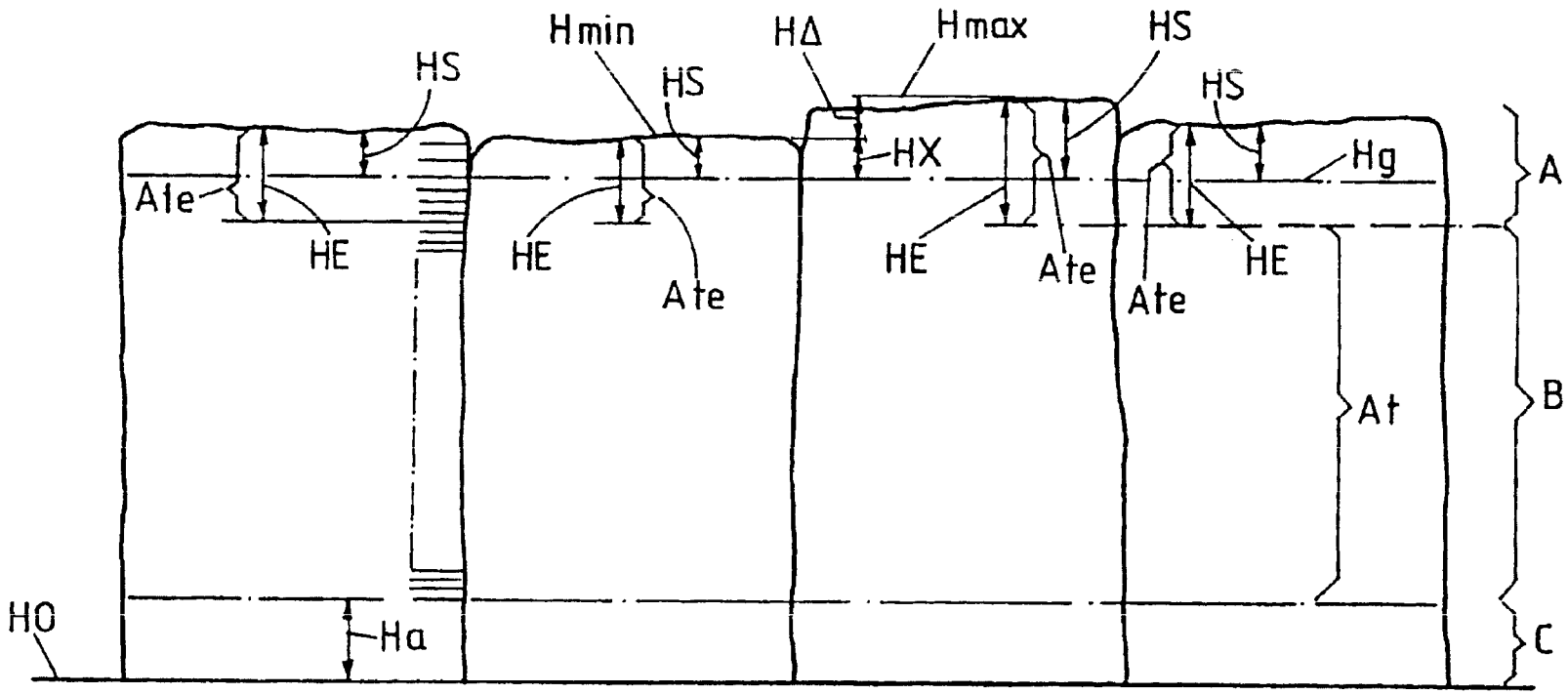

Additional Embodiments of the present invention are explained in the following in the sense of examples with reference to the illustrations in the Figures. It is shown in:

FIG. 5 a schematically shown bale laydown,

FIG. 6 a diagram explaining a first operating mode according to the present invention, FIG. 7 another bale group for explanation of an advantageous modification of the operating mode according to the FIG. 6, and in FIG. 8 a further bale group for explanation of possible interactions between the bale group structure and the programme for the bale opener in which arrangement the bale group according to the FIG. 7 also is extracted using the aforementioned modification, and in FIG. 9 the uppermost bale height zone of a bale group of the bale laydown according to the FIG. 5 for explaining a second operating mode according to the present invention.

A "bale laydown" of the type shown in the FIG. 5 has been explained e.g. in U.S. Pat. No. 4,951,358 (EP-C-221 306) and is shown here merely for the discussion of various bale group structures. The bale laydown comprises three bale groups BG1, BG2, and BG3. The group BG1 comprises four bales of very different bale heights BH1, BH2, BH3, BH4. This group of bales is ill composed presenting a marked wave structure in its surface contour. The second bale group BG2 comprises three bales only. The height difference between the highest and the lowest bale within the group 2 is smaller than within the group 1. In the group 2 a wave structure of the surface is present also, but it is less marked than the one in the group 1. The group 3 again comprises four bales efficiently placed side by side. Also in this case it was not possible to present equal bale height levels i.e. in the FIG. 5 the starting situation is shown with which the bale opener must cope after start-up—the release, compare EP-C-221 306. The bales in the group 3, however, are chosen in such a manner that the surface to be extracted gently increases in height level from left to right.

The present invention can be applied to all group structures shown in the FIG. 5. For explaining the basic principle it proves advantageous, however, to consider the more efficient composition according to the bale group 3. In the FIG. 6 a simplified view of an arrangement of this type is shown.

In the FIG. 6 the initial situation (before the start of the operation) is shown, i.e. the bale opener has not started its flock extracting operation. In the FIG. 6 a minimum bale height level Hm and a maximum bale height level HM and a height difference HΔ and a height difference HX can be seen. The bale height levels Hm, HM can be measured during a first pass of the bale extracting element and the height difference HΔ then can be determined by the computer.

Additionally a factor X was entered into the computer as a constant. Based on this factor X and on the height level difference HΔ the computer determines the height difference HX and thus the height position of an equalising plane, or a levelling height Hg according to the formula $HX=X\cdot H\Delta$ where HX represents the height difference between the surface of the lowest bale and the levelling plane Hg. The operating personnel additionally has to set the take-off depth At for the layer below the levelling plane Hg in a bale zone B (FIGS. 7 and 8). Based on these data the bale opener control system calculates the take-off depth Ats for any location S above the levelling plane Hg in a bale zone A according to the following rules:

$$Ats=At\cdot HS/HX$$

where:

At=Take-off depth below the levelling plane Hg.

In the FIGS. 7 and 8 the following references signify:

Atm=take-off depth for the lowest bale, where Atm=At is possible;

AtM=take-off depth for the highest bale, where AtM>Atm;

Ats=take-off depth between Atm and AtM at any location S, where the height difference at this location S is designated HS.

For the lowest bale the height HS equals the height HX. During the first pass preferentially the take-off depth Atm is applied over the full length. Subsequently preferentially the equalising levelling programme is applied which is effective over the height level difference HS on the basis of measured data concerning the surface structure of the bale group.

Instead of, or in addition to, said pass using the take-off depth Atm a start-up programme to be described later can be applied right away, which, as will be described later, ends before or after the levelling programme mentioned above.

In an alternative embodiment first a passage of the take-off element is started for "measuring" the bale group using the sensors provided thereon, without actually taking off flocks, whereupon fibre processing is started based on the levelling programme or on the start-up programme.

According to the equalising levelling programme, within the height zone A mentioned above, to any location S, in the longitudinal direction of a bale group, a corresponding take-off depth Ats for the corresponding bale zone (bale layer) above the levelling plane Hg can be coordinated. The take-off depth Ats coordinated to any given location S is derived in function of the ratio of the uppermost height level at this location to the height level of the levelling plane Hg. The take-off depth Ats determined for a given "longitudinal location" S is maintained until the levelling plane Hg has been reached. Thereupon the equalising levelling programme can be switched off as at this moment the surface of the bale group extends horizontally. Below the levelling plane Hg a uniform take-off depth At can be applied over the full length. This take-off depth At, however, can be adapted above the bale height level Hg as will be explained in the following with reference to the FIGS. 7 and 8.

In the FIGS. 7 and 8 it is assumed that the bale opener not only is equipped with a levelling programme to be applied within a height level difference HS but also with a start-up programme to be applied within a height difference HE and within the height zone A. For a programme of that type the operator determines a working parameter (in most cases the take-off depth At) which is to be applied during "normal"

take-off operation in the height zone designated B. Based on this parameter and on the software of the start-up programme the computer determines parameters which during the "start-up period" (i.e. during the take-off action from the uppermost layers down to the layers calculated by the programme) are applied. One of them is the "start-up take-off depth" Ate which only (FIG. 8) or also (FIG. 7) acts as a parameter for the levelling programme. The operating personnel thus can dispense with feeding in new data as the operation mode the use of a start-up programme being well known.

The start-up programme and the levelling programme preferentially are laid out as two routines of a software system. They are worked off simultaneously but mutually independent. They thus just by random coincidence terminate at the same moment as can be seen from the FIGS. 7 and 8.

The difference between the FIG. 7 and the FIG. 8 is seen in the greater difference in bale height levels which, as described in the following, results in different effects in the programmes loaded into the computer.

In the FIG. 7 e.g. the start-up programme is terminated before the equalising levelling programme is terminated which ends as the levelling height level Hg is reached whereas in the FIG. 8 the equalising levelling programme is terminated before the start-up programme is terminated in such a manner that the upper level of the height zone B and thus the beginning of the take-off depth At in vertical direction being maintained constant. is located at a lower level than the level of the levelling height Hg. From the description of these two FIGS. 7 and 8 it will be clear that the equalising levelling programme will end sooner if a more levelled initial contour of the bale height levels is present.

The bale surface contour, seen in the height and length directions of the bale laydown, is scanned using the height and length detecting means mentioned before, e.g. in U.S. Pat. No. 5,564,165 (DE 44 15 796) and U.S. Pat. No. 5,105,507 (EP 0 415 156 B1) and is entered into a computer containing the bale take-off programme.

In this description the control device including the computer is not shown and as devices are not subject of the present invention. They preferentially represent, however, a programmable control device in which arrangement programming can be adapted to the situation by feeding in certain parameter values.

The height level line designated Hg corresponds to the levelled bale group height at which the equalising levelling take-off programme for the individual bales of the bale group ends. The fibre take-off from this height level on is effected over the full length of the bales, i.e. for all bales, seen in horizontal direction, at the same take-off depth. It is to be noted in this context that this does not signify that the take-off depth in vertical direction necessarily remains constant from the height level Hg downward. There is the possibility that, depending on the composition of the bales in the bale group, as shown in the FIGS. 7 and 8, the start-up programme is terminated only at the lower limit of a height HE, i.e. at a level lower than the equalising levelling programme at a level designated HS in such a manner that until this lower limit of the height HE also after the common, or levelled bale height level Hg has been reached, the take-off depth decreases until the start-up program ends. This is indicated, schematically and in exaggerated manner, with short horizontal lines at the bale boundaries.

The other variant of the embodiment is shown in the FIG. 7 in which, the height level difference between Hmax and Hmin being greater than in the FIG. 8, the common bale height level Hg is located at a lower height level compared to the equalised bale height level Hg according to the FIG. 8. Correspondingly the start-up programme HE, as different from the equalising levelling programme HS, is kept shorter, ending above the levelled bale height Hg.

It is a matter of judgement whether the common bale height level Hg is adapted with the help of the selected value X, this value itself being chosen. This value can be chosen e.g. by the operator depending on the bale group composition.

In this arrangement the height value HX, as mentioned earlier, is generated by multiplying the height HΔ, representing the difference between the maximum bale height and the minimum bale height, by the factor X. The sum of the height HΔ and the height HX, deducted from the maximum height Hmax downward, yields the equalised height level of the common bale height Hg.

As mentioned earlier the starting take-off programme is calculated by the computer depending on a bale hardness value fed in by the operator. The bale hardness can be estimated empirically or can be measured using a sensor as shown and described in U.S. Pat. No. 5,105,507 (EP 0 415 156).

Ideally the user of the bale opener would like to obtain a constant take-off performance from top to bottom of the bales and from one end of the row of bales to the other. This could be achieved if the bales would be cubes presenting constant density at least within a bale. Such element, even if the density would vary from bale to bale, would present the same density from top to bottom. This is not the case by far for reasons known, however, with actual fibre bales which depending on the type of fibres, fibre humidity at the place where the fibres were pressed into bales, expand very differently as the ties are opened which can result in problems in the take-off operation.

The advantage of the method according to the FIGS. 7 and 8 offers the possibility of obtaining, as the bale group contour on one hand and the bale hardness distribution in the bale on the other hand are taken into consideration, an optimum equal height Hg and thus an optimum take-off performance in the start-up programme and in the leveling programme.

Finally it is to be noted, with reference to the FIGS. 6, 7 and 8, that below the bale zones A and B furthermore a lowest take-off zone C with a height difference Ha can be provided extending down to the floor, i.e. to the height level H0. Within this zone C the end take-off programme mentioned earlier can be applied according to which the take-off depth Ata gradually increases again towards the height level H0.

In an alternative FIG. 9 shows to a larger scale the upper layers of the bales of group 3 in FIG. 5. The lower layers are not important for the basic principle of the alternative mode of operation to be described and they have therefore been left out of FIG. 9, i.e. basically a process according to this variant operates on the "contour" of the group. The absolute bale height is of secondary importance (or even of no significance) in connection with this variant, but can of course measured for purposes of indirect determination of the contour.

In this alternative, in accordance with a second aspect of the invention, a factor or parameters determining a factor are entered into the computer of the bale opener whereby the relationship between the take-off depth at the highest point and the take-off depth at the lowest point of a bale group is predetermined. Thereafter, flocks are extracted from the bales with a take-off depth which is variable over the length of the group, until the bale height become equal or until the bales are exhausted. If equalization is achieved before all bales are exhausted, then flock extraction can continue down to ground level with a take-off depth which is invariable over the length of the bale group.

The take-off depth at some location between the maximum height level and the minimum height level can be established in function of the take-off depth at the highest and/or at the lowest location. For this purpose the difference actually present between the measured highest location and the lowest location within the bale group can be determined based on which the take-off depth required at any given location in the bale group can be determined in function of the factor and of the height difference with respect to the uppermost, or the lowest respectively, location in the contour. To each location in the contour e.g. a respective factor can be co-ordinated which is proportional to the predetermined factor and to the height position of the location within the contour.

The take-off depth at the uppermost and/or the lowest location in the bale groups can be entered into the computer. If both take-off depths are fed in, the factor mentioned before can be determined based on which the take-off depths at other height levels within the group can be determined. Preferentially, however, only one value of the take-off depth (either the one for the highest location or the one for the lowest location) and the predetermined factor are entered into the computer in such a manner that the take-off depth can be determined.

The second aspect according to the present invention thus provides a height equalizing programme using which a height leveling action can be effected below the lowest point in a bale group if the spinning mill operating personnel is not setting up an exaggerated height level difference in the initial situation of the bale group considered. The bale height level at which the equalizing action is completed is not predetermined, however. It depends on the actual height level difference in the initial situation and on the predetermined factor.

From FIG. 9 it will be apparent that the bales of group 3 exhibit a height difference HD between the highest and lowest bales. This difference could in principle be compensated by extracting flocks first from the highest bale only, and thereafter proceeding to other bales stepwise. A procedure of that kind is not acceptable, however, because the bales e.g. comprise cotton of different origins, that are to be blended. It is therefore desirable to extract flocks from each bale of this group during each "pass" in the longitudinal direction. It follows, therefore, that in order to achieve equalization the take-off depth must be selected in a variable manner over the length of the group in order to take-off at first a thicker layer from the higher bales and a less thick layer from the lower bales until (ideally) the bales of the group no longer exhibit any height difference.

However, the take-off depth is a critical technological parameter of the machine. The absolute take-off depth influences in particular the flock size, while changes in the take-off depth over the group length can influence the blend proportions downstream from the bale opener. In accordance with the second aspect of the invention, therefore, the selectability of the relationship between the maximum and the minimum take-off depths is constrained. In order to explain the basic principle, it will be assumed that the maximum take-off depth for a bale group is predetermined in relation to the minimum take-off depth for the same group by a factor (Z), i.e. ATmax=Z·Atmin, where Atmax represents the largest and Atmin the smallest take-off depths for this group. The invention is not limited to that kind of predetermination and variants will be described in the following by way of example.

For the purposes of explanation of the basic principle it will also be assumed the operator enters the minimum take-off depth Atmin into the computer. It will immediately be clear that the operator could just as well enter the take-off depth Atmax—the computer can adapt its calculations thereto so far as it "knows" which information has been entered. In still more complex embodiments, a "middle" take-off depth could be entered and the computer could be supplied with data or parameters which enable the required calculations. Variants of that kind are not excluded from the invention, but they do not contribute much to the basic principle and they will be ignored here for simplicity.

Accordingly, in accordance with the basic principle, on each pass a layer can be extracted from the highest bales which is Z-times as thick as the corresponding layer from the lowest bales. If the machine is operated with this take-off depth difference and the height difference HD is not too large in relation to the factor Z, then in the course of flock extraction a condition will be reached in which the bales do not exhibit any height difference any more. This is indicated schematically with a dotted line in FIG. 5. The plane indicated by the dotted line can be called the "equalization plane" Ae.

The position of the equalization plane Ae in relation to the surface of the highest or lowest bales in their starting condition can be calculated theoretically. From the geometry of the configuration illustrated in FIG. 5 the following relation can be derived:

$$HA=ATmin\cdot D—Atmax\cdot D-HD$$

where HA is the height difference between the surface of the lowest bale in the starting condition and the equalization plane Ae, and D is the number of passes needed to reach the equalization plane. It follows that $$HA=HD/(Z-1);\ Z=ATmax/ATmin.$$

The height difference can be determined by the bale opener by means of the sensors mentioned in the introduction and the factor Z is predetermined in this example. The determination of the position of the equalization plane is, however, for this aspect of the invention, non-essential and is preferably not taken into account in programming of the bale opener, unless it is desired to indicate to the spinning mill personnel what effects the effective structure of the bale-laydown (height difference within a bale group) in the starting condition will have on the working-off of the bales. A "comfort-solution" of that kind is not essential to the invention and will be ignored in the following description.

More important to the achievement of compensation over the whole length of the group is the question of what is to happen between the highest and the lowest points in the group. The reference numeral P indicates, for example, a randomly chosen position within the bale group. The position P exhibits a height difference HD1 relative to the highest bale. This height difference is measurable in the same way as the difference HD, i.e. each position within the group can be allocated its respective height difference; it does not matter whether this difference is determined relative to the highest bale or the lowest or to some reference level. The use of the highest level (or the lowest) enables the following simple proportional calculation, however:

$$ATP=Atmin\cdot ZP\ ZP=Z\cdot HD1/HD$$

where ZP is given by the formula and ATP is the take-off depth at the position P.

Each position in the bale group can therefore be allocated a respective factor ZP, which however cannot be determined in advance but has to be derived in dependence upon the bale contour actually found. The bale opener can therefore sense the bale contours and store them, whereupon it can work through a compensation program on the basis of the specified factor Z (i.e. the relation of the greatest to the smallest take-off depth). Insofar as the bale group has been assembled rationally, the compensation program will generate an equalization plane Ae at a relatively early stage in the overall operation. A less rational assembly will lead to later equalization (or in the worst case, to no equalization at all).

The bale contours are continually scanned during the take-off process. If equalization has been effected the signal processing device co-operating with the contour sensor devices detects that no more height level difference prevails. The equalizing leveling programme thus can be terminated , i.e. the extraction operation from there on is effected using a take-off depth which remains unchanged over the full length of the bale group for all bales.

The invention enables provision of a bale opener with a programmable control device which provides an equalizing leveling programme as well as a start-up programme for determining the take-off depth as a function of the variable density of the bales over the bale height, wherein a take-off depth to be applied in equalizing the bale height levels is determined on the basis of the starting program.

The invention enables provision of a bale opener with a programmable control device, characterized in that into the control system of the bale opener a factor, or parameters determining a factor, can be entered using which the ratio between the take-off depth at the highest point and the take-off depth at the lowest point of a bale group is predetermined.

The invention further enables provisions of a method of taking off fibre flocks from fibre bales arranged lined up in a row forming a bale group with a corresponding surface contour from which using a computer controlled fibre extracting element which is movable against the bale surface and covering the full width of the fibre bales fibres are taken off, with the following steps of the method, that said surface contour is scanned by corresponding sensors and the values measured are entered into a computer, based on a predetermined bale extraction programme the number of passes and predetermined take-off depths per pass for a fibre layer each corresponding to a part bale height are provided and that the bales are extracted accordingly by the take-off element, characterized by the following further steps of the method:

calculation of a difference (HΔ) between the uppermost and the lowest point of the surface contour, multiplication of said difference (HΔ) with a factor (X) entered into the computer previously, or case by case, and subtraction of the result from the lowest bale height for determining a common bale height level (Hg) from which on down the taking-off action is effected at the same take-off depth over the full length of the bale group.

It should be appreciated by those skilled in the art that various modifications and variations can be made in the present control method without departing from the scope or spirit of the invention. For example, the values, ratios, and the like used as parameters in the control method may be calculated or determined in various manners and with various configurations of machine components. Additionally, the mathematical steps and manipulations to arrive at the desired parameters may be carried out in various ways. It is intended that the present invention include such modifications and variations as come within the scope and spirit of the appended claims.

What is claimed is:

1. A method for operating a bale opening machine having a take-off device for removing a desired depth of material in a take-off layer from a top surface of a line of bales as the take-off device passes over the line of bales, said method comprising the steps of:

defining a desired normal take-off depth for the take-off device to be applied to all bales of the bale line;

computing actual take-off depths at predetermined positions along the bale line as a function of the normal take-off depth and a take-off factor computed for the respective positions, the respective take-off factors having a proportional value within a defined range based on relative bale height at the respective positions;

controlling the take-off device as a function of the actual take-off depths for each pass of the take-off device; and subsequently determining a new total height difference between a low bale height and a high bale height and setting the actual take-off depths to eliminate the influence of the take-off factor upon the total height difference being reduced to at least the value of the normal take-off depth.

2. The method as in claim 1, further comprising defining a height profile of the bale line in an initial pass of the take-off device over the bale line.

3. The method as in claim 2, further comprising computing an initial total height difference between the lowest and highest bale heights along the bale line from the height profile, and computing initial take-off factors as a function of a ratio between bale height difference at the respective positions and the initial total bale height difference.

4. The method as in claim 3, wherein a maximum take-off factor is assigned to the highest bale height position and a minimum take-off factor is assigned to the lowest bale height position, and take-off factors for all other positions along the bale line are calculated between the maximum and minimum take-off factors.

5. The method as in claim 3, comprising applying the initial set of take-off factors for each pass of the take-off device until the total height difference is reduced to at least the value of the normal take-off depth.

6. The method as in claim 1, comprising inputting the normal take-off depth and the value range for the take-off factors into a control system of the bale opening machine, and computing the actual take-off depths and controlling operation of the take-off device with the control system.

7. The method as in claim 1, wherein said determining of the total height difference prior to each pass of the take-off device comprises computing the total height difference based on the previous total height difference and the take-off depths at the high and low bale heights after the previous pass of the take-off device.

8. The method as in claim 1, further comprising controlling the take-off device as a function of bale density.

9. The method as in claim 8, comprising assigning a density factor to portions of the bales and applying the density factor with the take-off factor in computing the actual take-off depths.

10. The method as in claim 9, wherein the density factor is predetermined as a function of a perceived density characteristic of the bale line.

11. The method as in claim 10, further comprising entering the perceived bale density characteristic into a control system of the bale opening device and storing density factors in the control system corresponding to different bale density characteristics.

12. The method as in claim 9, wherein the portions of the bales to which the density factors are applied are determined as a function of bale height.

13. The method as in claim 12, wherein the portions of the bales to which the density factors are applied are defined as top portion based on a given percentage of bale height and a bottom portion based on a given percentage of bale height.

14. The method as in claim 13, wherein the given percentages of the top and bottom portions are a factor of the perceived bale density and are stored in a control system of the bale opening machine.

15. A method for operating a bale opening machine having a take-off device for removing a desired depth of material in a take-off layer from a top surface of a line of bales as the take-off device passes over the line of bales, said method comprising the steps of:

determining a total height difference between a low and high point along the line of bales;

defining a desired normal take-off depth for the take-off device;

computing actual take-off depths at predetermined positions along the line of bales as a function of the normal take-off depth and bale height at the respective positions;

controlling the take-off device as a function of the actual take-off depths for each pass of the take-off device; and prior to each pass of the take-off device, determining a new total height difference and setting the actual take-off depths to the normal take-off depth upon the new total height difference being reduced to at least the value of the normal take-off depth.

16. The method as in claim 15, wherein said step of computing the actual take-off depths comprises assigning a minimum and maximum take-off factor for the low and high points of the bale line and computing take-off factors for the remaining predetermined positions as a proportional function of a ratio of bale height difference at the positions to the total bale height difference.

17. The method as in claim 15, comprising determining an initial height profile of the bale line, computing the initial total height difference and take-off factors from the initial height profile, and re-computing a new total height difference for each subsequent pass of the take-off device.

18. The method as in claim 15, further comprising controlling the take-off depth at the positions as a function of bale density by applying a bale density factor in said computation of actual take-off depths.

19. The method as in claim 18, wherein the bale density factors are based upon a perceived bale density characteristic and are applied at discrete height portions of the bale.

20. The method as in claim 19, wherein the discrete height portions of the bale are determined as a percentage of initial bale height.

21. A method for operating a bale opening machine having a take-off device for removing a depth of material in a take-off layer from a top surface of a line of bales as the take-off device passes over the line of bales, said method comprising the steps of:

defining an initial height profile of the bale line in an initial pass of the take-off device over the bale line;

determining a total height difference between a low and high point along the line of bales from the height profile;

defining a desired normal take-off depth for the take-off device;

computing actual take-off depths at predetermined positions along the line of bales as a function of bale density and bale height by:

(a) computing a height take-off factor at the positions as a function of bale height difference at the positions compared to a bale height difference at a low and high point of the bale line;

(b) computing a density take-off factor at the positions as a function of perceived bale density and initial bale height;

(c) applying the height take-off factor and density take-off factor to the normal take-off depth to define an actual take-off depth at the positions;

controlling the take-off device as a function of the actual take-off depths for each pass of the take-off device; and prior to each pass of the take-off device, determining a new total height difference and setting the actual take-off depths to the normal take-off depth upon the new total height difference being reduced to at least the value of the normal take-off depth.

22. The method as in claim 21, wherein the step of computing the height take-off factor comprises computing an initial total height difference between the low and high bale heights along the bale line from the height profile, assigning a maximum height take-off factor to the position of the high bale and a minimum height take-off factor to the low bale, and assigning proportional height take-off factors for all other positions along the bale line between the maximum and minimum height take-off factors as a function of bale height difference at the positions compared to the initial total height difference between the low and high points of the bale line.

23. The method as in claim 22, comprising using the same height take-off factors for each pass of the take-off device without re-computing the take-off factors based on changes in bale height at the respective positions.

24. The method as in claim 21, wherein the step of computing density take-off factors comprises assigning density factors to top and bottom portions of the bales, the density factors having a value predetermined as a function of perceived density of the bales.

25. The method as in claim 24, wherein the top and bottom portions are based upon predetermined percentages of bale height, the percentages varying as a function of perceived bale density.

26. The method as in claim 24, wherein an operator enters perceived bale density into a control system of the bale opening machine.

27. The method as in claim 21, wherein an operator enters normal take-off depth, a value range for the height take-off factors, and perceived bale density into a control system of the bale opening machine which thereafter controls operation of the take-off device as a function of computed actual take-off depths.

* * * * *